US006347505B2

(12) United States Patent
Scheufeld

(10) Patent No.: US 6,347,505 B2
(45) Date of Patent: Feb. 19, 2002

(54) YARN BRAKE AND A TWO-FOR-ONE TWISTING SPINDLE HAVING SUCH A YARN BRAKE

(75) Inventor: Heinz Scheufeld, Korschenbroich (DE)

(73) Assignee: Volkmann GmbH (DE)

( * ) Notice: Subject to any disclaimer, the term of this patent is extended or adjusted under 35 U.S.C. 154(b) by 0 days.

(21) Appl. No.: 09/895,280

(22) Filed: Jun. 29, 2001

(30) Foreign Application Priority Data

Jul. 1, 2000 (DE) ..... 100 32 140

(51) Int. Cl.[7] ..... D01H 7/86
(52) U.S. Cl. ..... 57/58.86; 57/113
(58) Field of Search ..... 57/279, 58.83, 57/58.86, 113; 242/152.1, 147 R, 149, 156

(56) References Cited

U.S. PATENT DOCUMENTS

| | | | | |
|---|---|---|---|---|
| 3,975,893 A | * | 8/1976 | Franzen | 57/58.86 |
| 4,281,508 A | * | 8/1981 | Frebtzel-Beyme | 57/58.86 |
| 4,287,712 A | * | 9/1981 | Franzen | 57/58.86 |
| 4,391,090 A | * | 7/1983 | Charbonnier | 57/58.86 |
| 4,468,920 A | * | 9/1984 | Lorenz | 57/58.86 |
| 5,155,988 A | * | 10/1992 | Nieratschker | 57/58.86 |
| 5,487,263 A | | 1/1996 | Scheufeld et al. | |
| 5,581,988 A | | 12/1996 | Fink et al. | |

FOREIGN PATENT DOCUMENTS

| | | | | |
|---|---|---|---|---|
| DE | 3000443 | * | 7/1981 | 57/58.86 |
| DE | 3134763 | * | 6/1983 | 57/58.86 |
| FR | 1497288 | * | 10/1967 | 57/58.86 |

* cited by examiner

*Primary Examiner*—Danny Worrell
(74) *Attorney, Agent, or Firm*—R. W. Becker & Associates; R. W. Becker

(57) ABSTRACT

A two-for-one twisting machine is provided and includes includes a spindle having a yarn brake. The yarn brake includes a brake housing, a brake cartridge having opposed ends, first and second brake rings disposed within the brake housing, a guide conduit and a yarn intake tube extending within the guide conduit. A brake cartridge of the yarn brake has a first tube section, a second tube section, and a third tube section disposed axially intermediate the first tube section and the second tube section. The tube sections are all arranged in resiliently biased telescoping manner within one another such that the second tube section is resiliently biased in one axial direction outwardly from the third tube section and the first tube section is resiliently biased outwardly from the third tube section in an opposite axial direction opposite to the one axial direction.

13 Claims, 2 Drawing Sheets

YARN BRAKE AND A TWO-FOR-ONE TWISTING SPINDLE HAVING SUCH A YARN BRAKE

BACKGROUND OF THE INVENTION

The present invention relates to a yarn brake, especially, a yarn brake for a two-for-one twisting spindle or a two-for-one twisting spindle machine, having a substantially tube-shaped yarn brake housing in which a capsule-shaped brake cartridge is arranged, the brake cartridge comprising first and second telescopically movable tube portions which are movable against the bias of springs. Each tube portion of the brake cartridge has a substantially ball or curve shaped end portion with the pair of end portions disposed oppositely one another for each cooperating with a respective fixed axial position brake and/or a resiliently biased, axially movable brake ring with the pair of brake rings being at an adjustable axial spacing from one another.

Particularly in connection with the use of two-for-one twisting spindles, yarn brakes are known which comprise a yarn brake housing through which the yarn is axially trained. The inlet and outlet openings of the actual yarn brake region are respectively formed by brake rings having conical braking surfaces. The brake rings are typically comprised of a material having a high wear resistance. A brake cartridge, which forms the actual braking mechanism, extends between the individual inlet and outlet side of the brake rings and comprises two substantially cylindrical tube portions which are telescopically inserted into one another, and which include ball or curve shaped ends. The tubes enclose a spring which, upon the disposition of the brake cartridge in the yarn brake housing, outwardly resiliently biases the two tube end portions such that the curved-shaped ends of the tube portions are biased toward the brake rings and together therewith, as a function of the respective axial positions of the brake rings, exert the required braking force on the yarn traveling through the yarn brake. In accordance with the size of the required braking force, correspondingly stronger or weaker springs are disposed in the brake cartridge.

It is also conventionally known as well in connection with capsule yarn brakes that the actual braking body can be comprised of two tube sections, as is disclosed in German Industrial Model Patent Document 19 75 652, to provide a radially inwardly projecting flange portion on the inner end of the outermost tube section and a radially outwardly directed flange portion on the inner end of the innermost tube section so as to prevent or hinder an inadvertent release of the tube sections which are inserted into one another.

To permit adjustment or, respectively, setting of the braking force, it is known from DE 43 43 458 C2 (corresponding to U.S. Pat. No. 5,581,988) and DE 44 08 262 C2 (corresponding to U.S. Pat. No. 5,487,263), to set the axial position of the upper brake ring or, respectively, the brake ring carrier which supports this brake ring, in selected different settings so as to thereby vary the axial spacing of the upper and lower brake rings from one another. In the yarn brake disclosed in DE 43 43 458 C2, the lower brake ring is disposed in a fixed axial setting in the yarn brake housing while the upper brake ring is axially adjustably mounted in the yarn brake housing to thereby effect adjustment of the braking force. DE 44 08 262 C2 further discloses that the lower brake ring or, respectively, its brake ring carrier, can be adjusted relatively against the force of a return position spring by means of a downward pressure exerted from the direction of the upper brake ring, so that the downwardly moving brake cartridge, which is urged downwardly under the influence of gravity, can be supported against support elements which project radially inwardly from the inner wall of the yarn brake housing. The brake cartridge thereby loses contact with the upper and lower brake rings so that a training or feeding of the yarn through the yarn brake is possible.

It is additionally known in connection with two-for-one twisting spindles to arrange two brake cartridges in serial arrangement with one another in tandem manner so that, in total, four braking locations are available. A yarn brake of this configuration with one after another tandem brake cartridges has a fairly long axial extent.

It is an object of the present invention to provide simple and effective possibilities for altering the braking force.

SUMMARY OF THE INVENTION

In accordance with the present invention, a yarn brake is provided having the two tube sections as well as a third tube section added to the brake cartridge such that the three tube section are telescopically arranged for axial movement relative to one another against a spring force. The yarn brake of the present invention is characterized substantially in that, instead of a two piece brake cartridge, now a three piece brake cartridge is comprised together into a unit, whereby, for example, in contrast to a tandem-type, one after another serially activated brake cylinder, significant material and space savings can be realized.

In accordance with a preferred embodiment of the yarn brake of the present invention, it is provided that the yarn brake includes a guide conduit which communicates with its yarn brake housing, the yarn guide conduit receiving therein an axially adjustably positionable yarn intake tube adjustable to at least two positions relative to the guide conduit and having an inner end which supports the third brake ring thereon. By adjustment of the axial position of the yarn intake tube, one can, as desired, adjust the third brake ring relative to the third brake surface, so that this third brake surface can be rendered inoperable. By lowering of the yarn intake tube, the braking action of the third brake surface can be put into operation and this, in fact, in addition to the possibilities which are offered by positional adjustment of the first or the second brake ring carriers.

BRIEF DESCRIPTION OF THE DRAWINGS

The object and advantages of the present invention will appear more clearly from the following specification in conjunction with the accompanying schematic drawings, in which.

DETAILED DESCRIPTION OF THE PREFERRED EMBODIMENT

Figure 1:
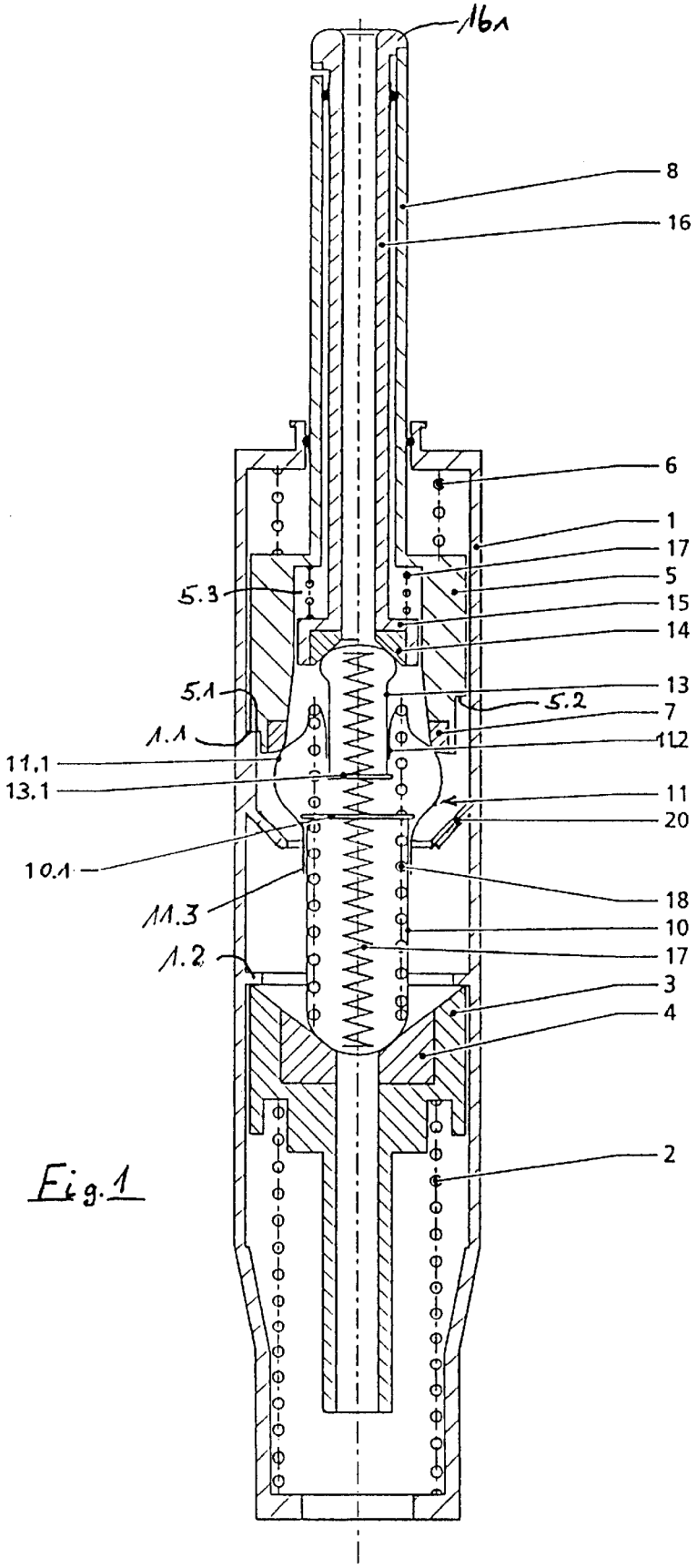
FIG. 1 is a sectional front elevational view of one embodiment of the yarn brake of the present invention for a two-for-one twisting spindle.

As shown in FIG. 1, the one embodiment of the yarn brake of the present invention includes a substantially cylindrical brake housing 1, in whose interior is disposed, a piston-type configured brake ring 3 which is resiliently biased against an annular shoulder 1.2 by a spring 2 and which supports a first yarn brake ring 4. A second brake ring carrier 5, which is cup-shaped, is mounted in the upper region of the brake housing 1 and is resiliently biased by a spring 6. The second brake ring carrier 5 is secured to the lower end of a guide conduit 8, which extends upwardly in the brake housing 1, and which includes an upper end communicated with the exterior of the brake housing. The cup-shaped brake ring carrier 5 is, in the manner disclosed in DE 43 43 458 C2, divided around its outer circumference into a plurality of support shoulders 5.1, 5.2, whose surfaces are axially offset from one another. By rotation of the guide conduit 8, a respective one of the support shoulders, such as, for example, the support shoulder 5.1, can be brought into seated disposition against a radially inwardly extending projection 1.1 extending from the inner wall of the brake housing 1. In this manner, the axial position of the brake ring 7 within the yarn brake housing 1 and, thus, the braking force applied to the yarn can be adjusted and justified.

The position of the brake ring carrier 5 and, thus, the position of the upper brake ring 7 can be adjusted in a conventional manner as can be seen, for example, in DE 44 08 262 C2.

A yarn intake tube 16 is in an inserted position in the guide conduit 8 and has at its upper end a radially outwardly extending flange portion 16.1 which is in radially overlapping relationship above the upper end of the guide conduit 8. A third brake ring carrier 15 is supported at the lower end of the yarn intake tube 16 and it supports therein a third upper brake ring 14. The brake ring carrier 15 is axially movably positionable in the cylinder chamber 5.3 of the cup-shaped brake ringer carrier 5 and is resiliently biased by a spring 17 extending thereagainst from the bottom of the cylinder chamber 5.3.

Figure 2:
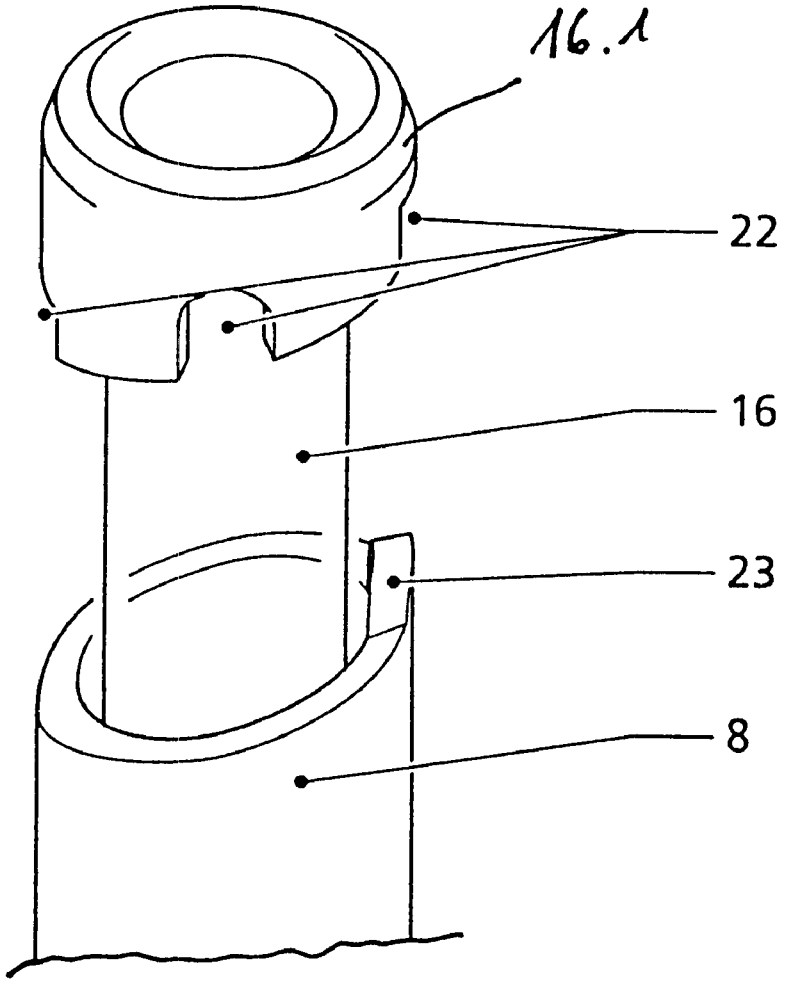
FIG. 2 is an enlarged perspective view of the yarn intake tube of a two-for-one twisting spindle.

As seen in FIG. 2, an angled surface is formed on the upper edge of the guide conduit 8 and has a nose-shaped projection 23 extending axially outwardly therefrom. The lower edge of the radially outwardly extending flange portion 16.1 of the yarn intake tube 20 has an angled surface whose angle corresponds to the angled surface formed on the upper edge of the guide conduit 8 and its circumference is divided into a plurality of axially extending recesses or notches 22, each of which has a bottom at a respective different spacing from the upper edge of the yard intake tube 16.

One can adjust the axial position of the brake ring carrier 15 within the cup-shaped brake ring carrier 5 by axial movement and turning of the yarn intake tube 16 so as to seat the projection 23 in a selected one of the recesses 22, whereby the cooperative operation of the hereinafter described brake cartridge offers additional possibilities for the simplified adjustment or, respectively, variation of the yarn braking force.

The brake cartridge in accordance with the present invention is comprised of three tube sections 10, 11, and 13 telescopically arranged within one another. The first, lower tube section 10 is substantially in the shape of a cylindrical tube having a lower ball-or-curved-end portion and a radially outwardly extending flange portion 10.1 formed on the open end of the cylindrical tube. The second, upper tube section 13 is comprised of a cylindrical tube whose upper end is formed with a ball-or-curved-shaped end portion and whose lower end has a radially outwardly extending flange portion 13.1 formed thereon. The third tube section 11 has a substantially outwardly flared middle region 11.1 from which a cylindrical portion 11.3 extends downwardly and another cylindrical portion 11.2 extends upwardly. The upwardly extending cylindrical portion 11.2 has an inner cylindrical section which forms an annular space.

The first tube section 10 is in engagement at its curved shaped end portion with the lower brake ring 4, the second tube section 13 is in engagement, via its curved shaped end portion with the upper brake ring 14, and the middle tube section 11 is in engagement, via its outwardly flared middle region 11.1, with the brake ring 7.

The lower tube section 10 is inserted from below into the middle tube section 11, whereby the flange portion 10.1, whose diameter is greater than the diameter of the cylindrical tube 11.1, prevents a withdrawal, or, respectively, an inadvertent release of the tube section from the middle tube section 11. In the same manner, the flange portion 13.1 of the upper tube section 13, which lies above the cylinder tube 11.2, secures against an inadvertent withdrawal of the upper tube section 13 from the middle tube section 11.

The insertion of the outer tube sections 10 and 13 into the middle tube section 11 is possible in spite of the radially outwardly projecting flange portions 10.1 or, respectively, 13.1, as such insertion can be effected by means, for example, of elastic deformation of the cylinder portions 11.2 or, respectively, 11.3.

A first spring 17 is disposed within the three-section brake cartridge and extends to and from the curved shaped end portions of the tube sections 10 and 13. A second spring 18 extends to and between the curved shaped end portion of the lower tube section 10, on the one hand, and the bottom formed by a support shoulder on the upper annular space of the middle tube section 11, on the other hand.

The braking force applied by the yarn brake of the present invention can, thus, be adjusted in correspondence with the spring force of the springs 17 and 18 and their respective axial positioning of the respective brake rings 4, 7, and 14.

If, in the event that a yarn is to be trained or threaded into the yarn brake, the lower brake ring carrier 3 is moved against the biasing force of the spring in a conventional manner such as, for example, in a pneumatic manner, and the support elements 20 extending radially inwardly from the inner wall of the yarn brake housing 1 serve to support or, respectively, catch, the brake cartridge, in that these support elements engage the radially outwardly directed thickening or, respectively, flaring, of the middle tube section 11. The flange portion 10.1 or, respectively, 11.2, hinders in this operational condition a falling apart of the brake cartridge.

The specification incorporates by reference the disclosure of German priority document 100 32 140.2-26 of Jul. 1, 2000.

The present invention is, of course, in no way restricted to the specific disclosure of the specification and drawings, but also encompasses any modifications within the scope of the appended claims.

What I claim is:

1. A yarn brake comprising:

a generally elongate brake housing having a longitudinal axis;

a guide conduit extending generally co-axially within the brake housing and having an open end opening to the exterior at one axial end of the brake housing;

a brake cartridge having opposed ends each of which has a curved shape, the brake cartridge having a first tube section, a second tube section, and a third tube section being disposed axially intermediate the first tube section and the second tube section, and the first tube section, the third tube section, and the second tube section all arranged in resiliently biased telescoping manner within one another such that the second tube section is resiliently biased in one axial direction outwardly from the third tube section and the first tube section is resiliently biased outwardly from the third tube section in an opposite axial direction opposite to the one axial direction;

a first brake ring disposed within the brake housing, the first brake ring being resiliently biased in the one axial direction;

a second brake ring disposed within the brake housing and being a selected one of a fixed axial distance from the first brake ring and a variable axial distance from the first brake ring and being resiliently biased in the opposite axial direction; and a third brake ring supported within the brake housing at a position axially intermediate the first brake ring and the second brake ring for engaging the third tube section of the brake cartridge, the brake cartridge being releasably compressively engaged by the first brake ring pressing against the first tube section of the brake cartridge and the second brake ring pressing against the second tube section of the brake cartridge and the third brake ring engaging the third tube section of the brake cartridge.

2. A yarn brake according to claim 1, wherein the third tube section includes an inner support shoulder for engagement by a second spring, the second spring extending between this inner support shoulder and a shoulder formed on both of the tube sections.

3. A yarn brake according to claim 2, wherein the third tube section includes a radially outwardly extending flared central region, a lower cylindrical portion extending axially from one end of the central region for insertion of the upper end of the first tube section thereinto, and an upper cylindrical portion extending axially from an opposite end of the central region and having an inner wall forming an annular space for axially adjustable receipt of the lower end of the second tube section therein.

4. A yarn brake according to claim 3, wherein the bottom of the annular space of the support shoulder is configured for receiving therein the second spring.

5. A yarn brake according to claim 1 and further comprising release security elements which prevent or minimize an inadvertent release of the tube sections inserted in one another.

6. A yarn brake according to claim 5, wherein each of the two outer tube sections include a radially outwardly extending flange portion formed on the respective inner end of the tube section, the outer diameter of the respective flange portion being larger than the inner diameter of the cylinder portion of the third tube section.

7. A yarn brake according to claim 1, wherein the yarn brake housing is communicated with a guide conduit in which an axially displaceable yarn intake tube, displaceable between at least two positions, is disposed, the inner end of the yarn intake tube supporting thereon the brake ring for the upper tube section.

8. A yarn brake according to claim 7, wherein an angled surface is formed on the upper edge of the guide conduit having an axially outwardly projecting projection extending therefrom and the yarn intake tube includes a radially outwardly extending flange portion on whose lower edge is formed a plurality of axially extending recesses, each recess having a bottom at a respective different axially spacing from the upper end of the yarn intake tube and each recess for receiving therein the projection to effect adjustable seating of the yarn intake tube on the guide conduit.

9. A yarn brake according to claim 7, wherein the guide conduit supports at its lower end a resilient biased brake ring carrier for supporting thereon the brake ring which cooperatively engages the third tube section and the brake ring carrier is adjustably positionable in various axial positions within the yarn brake housing.

10. A yarn brake according to claim 9, wherein the brake ring carrier, which supports thereon the upper brake ring, is resiliently biased within the brake ring carrier and axially positionable relative thereto.

11. A yarn brake according to claim 10, wherein the lower brake ring is supported in a brake ring carrier, which is configured in a piston shape and disposed in the yarn brake housing and which is movable against the force of a return position spring to permit thereby release of the brake cartridge and, beneath the radially outwardly extending flared portion of the middle region of the third tube section, a plurality of support components are provided which extend radially inwardly from the inner wall of the yarn brake housing for engaging and supporting the middle region of the release brake cartridge.

12. A spindle comprising:

a yarn brake including a generally elongate brake housing having a longitudinal axis;

a guide conduit extending generally co-axially within the brake housing and having an open end opening to the exterior at one axial end of the brake housing;

a brake cartridge having opposed ends each of which has a curved shape, the brake cartridge having a first tube section, a second tube section, and a third tube section being disposed axially intermediate the first tube section and the second tube section, and the first tube section, the third tube section, and the second tube section all arranged in resiliently biased telescoping manner within one another such that the second tube section is resiliently biased in one axial direction outwardly from the third tube section and the first tube section is resiliently biased outwardly from the third tube section in an opposite axial direction opposite to the one axial direction;

a first brake ring disposed within the brake housing, the first brake ring being resiliently biased in the one axial direction;

a second brake ring disposed within the brake housing and being a selected one of a fixed axial distance from the first brake ring and a variable axial distance from the first brake ring and being resiliently biased in the opposite axial direction; and a third brake ring being supported within the brake housing at a position axially intermediate the first brake ring and the second brake ring for engaging the third tube section of the brake cartridge, the brake cartridge being releasably compressively engaged by the first brake ring pressing against the first tube section of the brake cartridge and the second brake ring pressing against the second tube section of the brake cartridge and third brake ring engaging the third tube section of the brake cartridge.

13. A two-for-one twisting spindle machine comprising:

a spindle having a yarn brake including a generally elongate brake housing having a longitudinal axis;

a guide conduit extending generally co-axially within the brake housing and having an open end opening to the exterior at one axial end of the brake housing;

a brake cartridge having opposed ends each of which has a curved shape, the brake cartridge having a first tube section, a second tube section, and a third tube section being disposed axially intermediate the first tube section and the second tube section, and the first tube section, the third tube section, and the second tube section all arranged in resiliently biased telescoping manner within one another such that the second tube section is resiliently biased in one axial direction outwardly from the third tube section and the first tube section is resiliently biased outwardly from the third tube section in an opposite axial direction opposite to the one axial direction;

a first brake ring disposed within the brake housing, the first brake ring being resiliently biased in the one axial direction;

a second brake ring disposed within the brake housing and being a selected one of a fixed axial distance from the first brake ring and a variable axial distance from the first brake ring and being resiliently biased in the opposite axial direction; and a third brake ring being supported within the brake housing at a position axially intermediate the first brake ring and the second brake ring for engaging the third tube section of the brake cartridge, the brake cartridge being releasably compressively engaged by the first brake ring pressing against the first tube section of the brake cartridge and the second brake ring pressing against the second tube section of the brake cartridge and the third brake ring engaging the third tube section of the brake cartridge.

* * * * *

UNITED STATES PATENT AND TRADEMARK OFFICE

CERTIFICATE OF CORRECTION

PATENT NO. : 6,347,505 B2
DATED : February 19, 2002
INVENTOR(S) : Scheufeld

It is certified that error appears in the above-identified patent and that said Letters Patent is hereby corrected as shown below:

Title page,
Item [57], ABSTRACT,
Line 1, should read as follows:
-- A two-for-one twisting machine is provided and includes a spindle having a yarn brake. --

Signed and Sealed this

Twentieth Day of August, 2002

*Attest:*

*Attesting Officer*

JAMES E. ROGAN
*Director of the United States Patent and Trademark Office*